US005618172A

United States Patent [19]

Berger

[11] Patent Number: 5,618,172

[45] Date of Patent: Apr. 8, 1997

[54] SPINNING PUMP FOR POLYAMIDES

[75] Inventor: Luzius Berger, Kriens, Switzerland

[73] Assignee: Hone Poulenc Viscosuisse SA, Emmenbruecke, Switzerland

[21] Appl. No.: 532,556

[22] PCT Filed: Feb. 7, 1995

[86] PCT No.: PCT/CH95/00029

§ 371 Date: Sep. 15, 1995

§ 102(e) Date: Sep. 15, 1995

[87] PCT Pub. No.: WO95/22002

PCT Pub. Date: Aug. 17, 1995

[30] Foreign Application Priority Data

Feb. 14, 1994 [CH] Switzerland ..... 427/94

[51] Int. Cl.[6] ..... F04C 2/18

[52] U.S. Cl. ..... 418/206.4

[58] Field of Search ..... 418/206.1, 206.4

[56] References Cited

U.S. PATENT DOCUMENTS

| | | | |
|---|---|---|---|
| 2,460,649 | 2/1949 | Muller | 418/206.4 |
| 3,817,668 | 6/1974 | Mayer et al. | 418/206.4 |

FOREIGN PATENT DOCUMENTS

| | | | |
|---|---|---|---|
| 0189670 | 8/1986 | European Pat. Off. . | |
| 0447766 | 9/1991 | European Pat. Off. . | |
| 948868 | 2/1949 | France | 418/206 |
| 518993 | 2/1931 | Germany | 418/206 |
| 1553125 | 4/1970 | Germany | 418/206 |
| 63-248989 | 10/1988 | Japan | 418/206 |

*Primary Examiner*—John J. Vrablik
*Attorney, Agent, or Firm*—Michael J. Striker

[57] ABSTRACT

The spinning pump for melt spinning of polyamides includes a back plate (5), a front plate (7), a central plate (6) extending between the front plate (7) and the back plate (5) and a pair of gear wheels (8,8'). The central plate (6) is provided with a bore (10) for feeding a melt into the central plate and another bore (10') for feeding the melt out of the central plate. The bores (10,10') each have transverse partially circular cross sections with cross-sectional areas decreasing from the front side (6') of the central plate (6) to the back side (6"). The partially circular cross sections of each of the bores (10,10') have center points on a parabolic arc or path (13*b*) from the front side (6') to the back side (6") of the central plate (6). This shape and structure for the bores (10,10') prevents cracked deposits from forming inside the pump channels and increases the productivity of top-quality melt extrusion by over 10%.

6 Claims, 2 Drawing Sheets

SPINNING PUMP FOR POLYAMIDES

BACKGROUND OF THE INVENTION

The invention relates to a spinning pump for melt spinning of polyamides comprising a back plate, a front plate, a central plate with a bore of partially circular cross section for supply of the melt and a bore of partially circular cross section for removing the melt, and a pair of gear wheels.

In melt spinning of polyamide 6.6, the quality of the filaments produced can decrease, in continuous operation, after a certain time. The reason for this has been sought in the melt portion of the system and in the starting polymer. It has now been found that deposits of cracked polyamide 6.6 in the spinning pump can be one of the causes of the reduced quality, which is also expressed in high fluff counts.

Gear pumps for melt spinning of polymer melts are known (European Patent Application EP-A2 0 447 766). The known spinning pumps are connected to a spinning pump block, which serves as a connection between an extruder and the spinning nozzles. The channels of the spinning pump block communicate directly with the bore channels of the spinning pump. In the spinning of nylon, especially in the melt spinning of nylon 6.6, deposits are found in the spinning pump that can make themselves felt over the course of spinning in the form of increasing fluff counts and reduced quality. Known spinning pumps have cylindrical inlet and outlet bores in the central plate, which after relatively long periods of operation exhibit deposits of polymer and products of its decomposition.

SUMMARY OF THE INVENTION

The object of the invention is to make available a spinning pump for melt spinning of polyamide 6.6 that is free of dead zones and that makes it possible to assure encrustation-free operation so as to attain improved quality.

A further object is to increase the productivity of the continuous melt spinning process of polyamide 6.6.

This object is attained in accordance with the invention in that the bores having the partially circular cross sections on the front of the central plate are formed so that the cross-sectional area of the bores toward the back of the central plate is reduced in relation to the cross-sectional area at the front side, and the center points of the transverse partially circular cross sections of the bores are located on a parabolic arc or path from the front side of the central plate to the back side.

The parabolic shape of the bores enables continuous operation free of dead zones.

It is suitable if the profile of the bores extends in a continuous and nonlinear function, whose first derivative is continuous. The profile of a parabola has proved to be preferred.

It is also suitable if the transition of the bores from the central plate to the back plate is uninterrupted and free of kinks and represents the beginning of the profile that the bores follow.

It is especially advantageous if the profile of the center points of the partial circles forming the bores ends on the back side of the central plate in such a way that the free partial circular area of the bores is as small as possible, but preferably tends towards zero. The term "partial circular area" is to be understood according to the invention as the free cross-sectional area, which is a circle minus the imaginary two portions of the circle that are cut off from the cross-sectional area by the rotation of a tooth of the two gear wheels.

BRIEF DESCRIPTION OF THE DRAWING

The invention will now be described in further detail in conjunction with a drawing, in which.

DESCRIPTION OF THE PREFERRED EMBODIMENT

Figure 1:
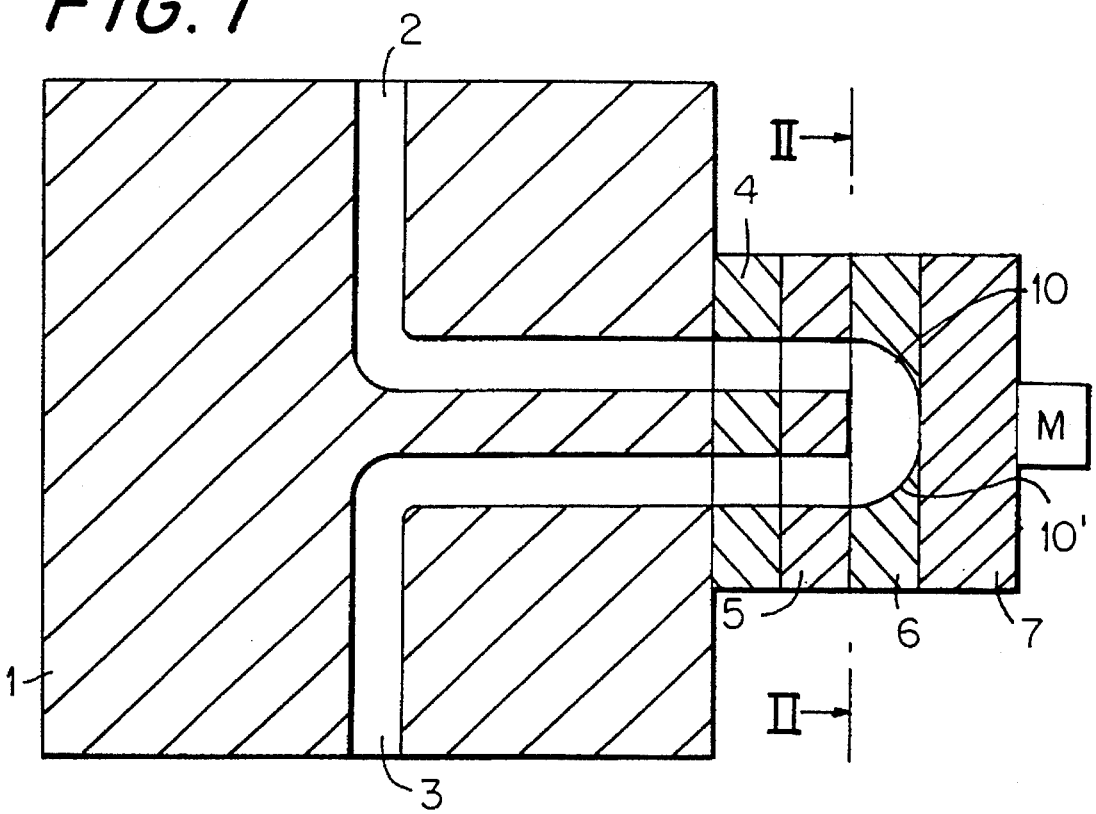
FIG. 1, is a cross-sectional view of a spinning pump with a pump block.

In FIG. 1, reference numeral 1 designates a spinning block. A duct 2 connected with an unshown extruder and a duct 3 connected with an unshown spinning nozzle both pass through the spinning block 1. The spinning pump is permanently connected to the spinning block 1 via a pump protecting plate 4. The essential components comprise a back plate 5 and a central plate 6. A front plate 7 forms the closure relative to a motor M. The front plate 7 as a rule includes a base plate.

Figure 2:
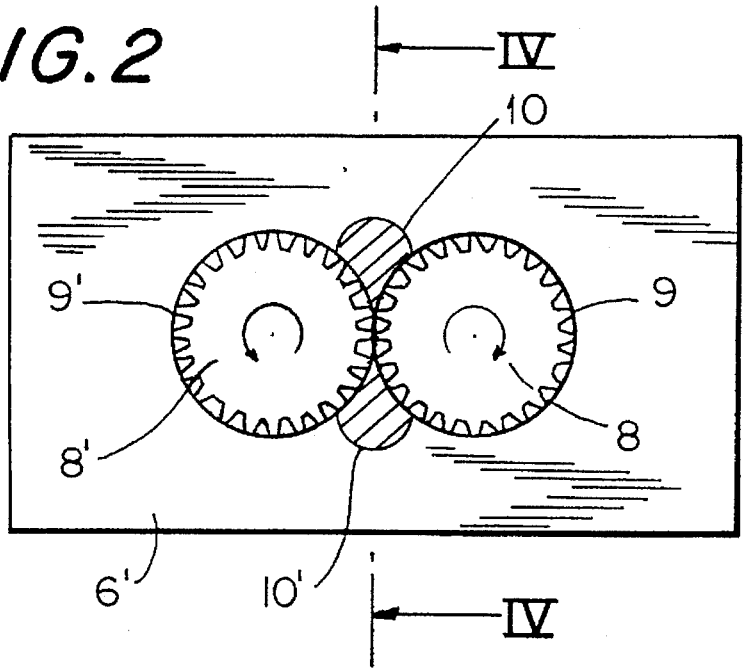
FIG. 2 is a schematic cross-sectional view taken along the line II—II on the front side of the central plate in the region of the polymer inlet and outlet.

FIG. 2 shows a section taken along the section line II—II of FIG. 1 through the front portion of the central plate 6 of a gear pump. The gear wheels are marked 8, 8'. They are disposed in cylindrical bores 9, 9'. A noncylindrical bore 10 of partially circular cross section communicates with the duct 2, and the noncylindrical bore 10' communicates with the duct 3. The diameters of the ducts 2 and 3 are identical to the diameters of the bores 10, 10' through the central plate 6 to the back plate 5. The direction of motion of the gear wheels is represented by arrows in FIG. 2.

Figure 3:
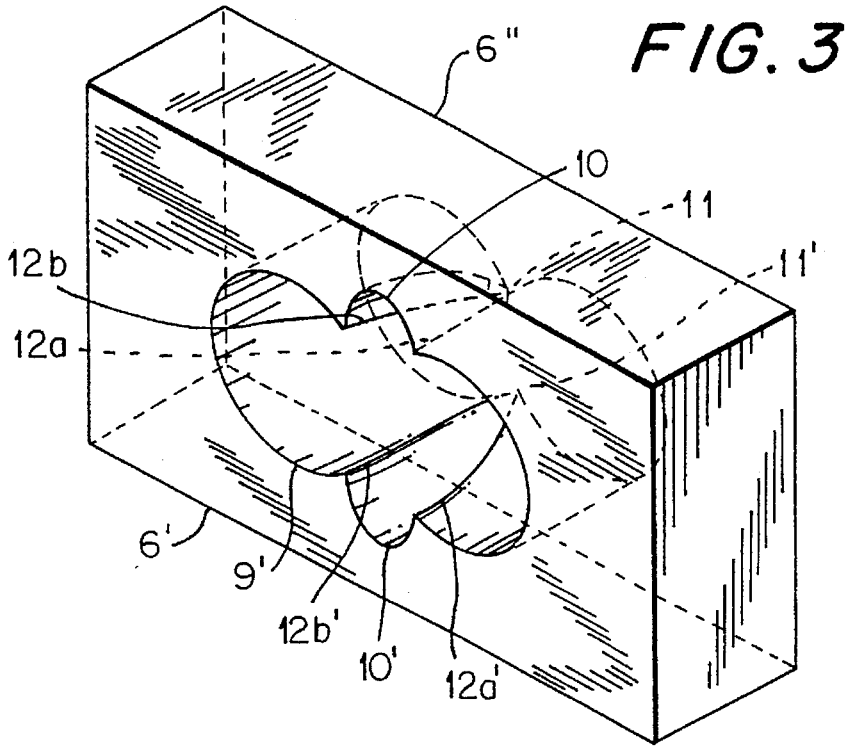
FIG. 3 is a perspective view of the central plate from the spinning pump of FIG. 1.

In FIG. 3, the central plate is shown in profile. The section shows a front side 6' and a back side 6" of the central plate 6. The cylindrical bores 9 and 9' for receiving the gear wheels 8, 8' are shown from the front side 6'. An edge **12*a* and an edge 12*b* of the bore 10 meet or intersect one another at a point 11; the edges 12*a*' and 12*b*' of the bore 10' meet or intersect at a point 11'**.

Figure 4:
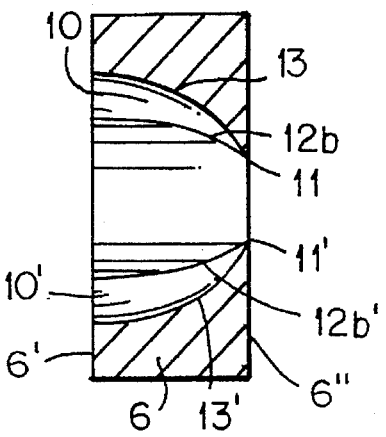
FIG. 4 is a cross-sectional view taken along the section line IV—IV passing through the central plate with the bores according to the invention.
Figure 5:
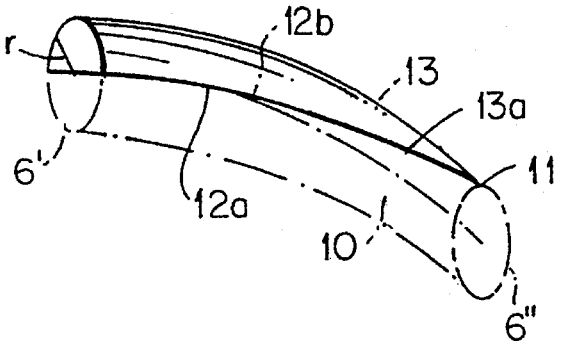
FIG. 5, a schematic illustration of the bore according to the invention.

FIG. 4 is a cross-sectional view through the noncylindrical bores 10,10' taken along the section line IV—IV of FIG. 2. The edge **12*b* and an edge 13 extend from the front 6' of the central plate 6 and meet at the point 11; the edge 12*b*' and an edge 13' meet at the point 11'. The parabolic shape of the bores 10, 10' according to the invention is described by lines 13, 13'. In the schematic illustration of FIG. 5, the shape of the bore 10 is shown. The radius r of the transverse partially circular cross section of the bore 10 remains constant over its entire length through the central plate 6. The parabolic course of the bore 10 is described by the edge 13 and by the center points 13*a* of the transverse partially circular cross sections, which meet at the back 6" of the central plate 6 at the point 11**.

In operation of the pump, a melt is forced by extruder pressure through the duct 2 of the bore 10. By the contrary rotation of the gear wheels 8 and 8', the melt is pumped from the bore 10 via the bore 10'. From the bore 10', the melt is supplied at increased pressure through the duct 3 of a the unshown spinning nozzle.

The spinning pump according to the invention enables pumping without dead zones and an increase of productivity by more than 10%. Deposits of cracked PA 6.6 are practically prevented.

I claim:

1. A spinning pump for melt spinning of polyamides, said spinning pump comprising a back plate (5), a front plate (7), a central plate (6) having a front side (6') and a back side (6"), said central plate extending between the front plate (7) and the back plate (5) and containing a pair of cylindrical bores (9,9'), and a pair of intermeshing gear wheels (8,8') disposed in said pair of cylindrical bores; wherein said central plate (6) is provided with a bore (10) for feeding a melt into the central plate and another bore (10') for feeding the melt out of the central plate, and the bore (10) and the other bore (10') each have transverse partially circular cross sections with cross-sectional areas decreasing from the front side (6') of the central plate (6) to the back side (6") of the central plate (6) and said transverse partially circular cross sections of said bores (10,10') have center points located on a parabolic arc (13*b*) from the front side (6') to the back side (6") of the central plate (6).

2. The spinning pump as defined in claim 1, wherein said transverse partially circular cross sections of said bores (10,10') each have a radius (r) and said radius (r) is constant for said partially circular cross sections distributed from the front side (6') to the back side (6") of the central plate (6).

3. The spinning pump as defined in claim 1, wherein the bores (10,10') have a continuous and nonlinear profile having a continuous first derivative.

4. The spinning pump as defined in claim 1, wherein said bores (10,10') extend smoothly from the front side (6') to the back side (6") of the central plate (6) without a discontinuity and free of kinks.

5. The spinning pump as defined in claim 1, wherein the parabolic arc of the center points of said transverse partially circular cross sections of said bores (10,10') end at a point (11,11') on the back side (6") of the central plate (6).

6. The spinning pump as defined in claim 5, wherein the cross-sectional areas of said transverse partially circular cross sections of said bores (10,10') at the back side (6") of the central plate (6) amount to from 0 to 50% of the cross-sectional areas of said transverse partially circular cross sections on the front side (6').

* * * * *

UNITED STATES PATENT AND TRADEMARK OFFICE

CERTIFICATE OF CORRECTION

PATENT NO. : 5,618,172
DATED : April 8, 1997
INVENTOR(S) : Luzius Berger

It is certified that error appears in the above-identified patent and that said Letters Patent is hereby corrected as shown below:

Title page item [73], should read --Rhone-Poulenc Viscosuisse SA,--

Signed and Sealed this

Ninth Day of December, 1997

*Attest:*

Bruce Lehman

BRUCE LEHMAN

*Attesting Officer*

*Commissioner of Patents and Trademarks*